US005507684A

United States Patent [19]

Schwär

[11] Patent Number: 5,507,684

[45] Date of Patent: Apr. 16, 1996

[54] MACHINE FOR THE TWO-STAGE MACHINING OF PREGROUND SHAFTS

[75] Inventor: Rudolf Schwär, Wuppertal, Germany

[73] Assignee: Ernest Thielenhaus KG, Wuppertal, Germany

[21] Appl. No.: 289,382

[22] Filed: Aug. 11, 1994

[30] Foreign Application Priority Data

Aug. 20, 1993 [DE] Germany ..... 43 28 006.4

[51] Int. Cl.[6] ..... B24B 21/16; B24B 49/00

[52] U.S. Cl. ..... 451/5; 451/168; 451/302; 451/310

[58] Field of Search ..... 451/5, 11, 62, 451/162, 168, 173, 174, 296, 302, 303, 307, 310, 415, 439

[56] References Cited

U.S. PATENT DOCUMENTS

| | | | |
|---|---|---|---|
| 4,290,238 | 9/1981 | Judge, Jr. | 451/163 |
| 4,682,444 | 7/1987 | Judge et al. | 451/49 |
| 4,993,191 | 2/1991 | Judge et al. | 451/303 |
| 5,058,325 | 10/1991 | Pineau | 451/307 |
| 5,148,636 | 9/1972 | Judge et al. | 451/307 |

FOREIGN PATENT DOCUMENTS

| | | |
|---|---|---|
| 3841976 | 1/1990 | Germany . |

*Primary Examiner*—Maurina T. Rachuba
*Attorney, Agent, or Firm*—Herbert Dubno

[57] ABSTRACT

A two-stage machining process is carried out using control of a pair of levers upon which one pair of grinding tools is provided. The second stage of the machining process is effected by grinding tools, e.g. immobilized segment of a grinding belt or band of tongs whose arms are inserted between the levers.

16 Claims, 3 Drawing Sheets

FIG. 3
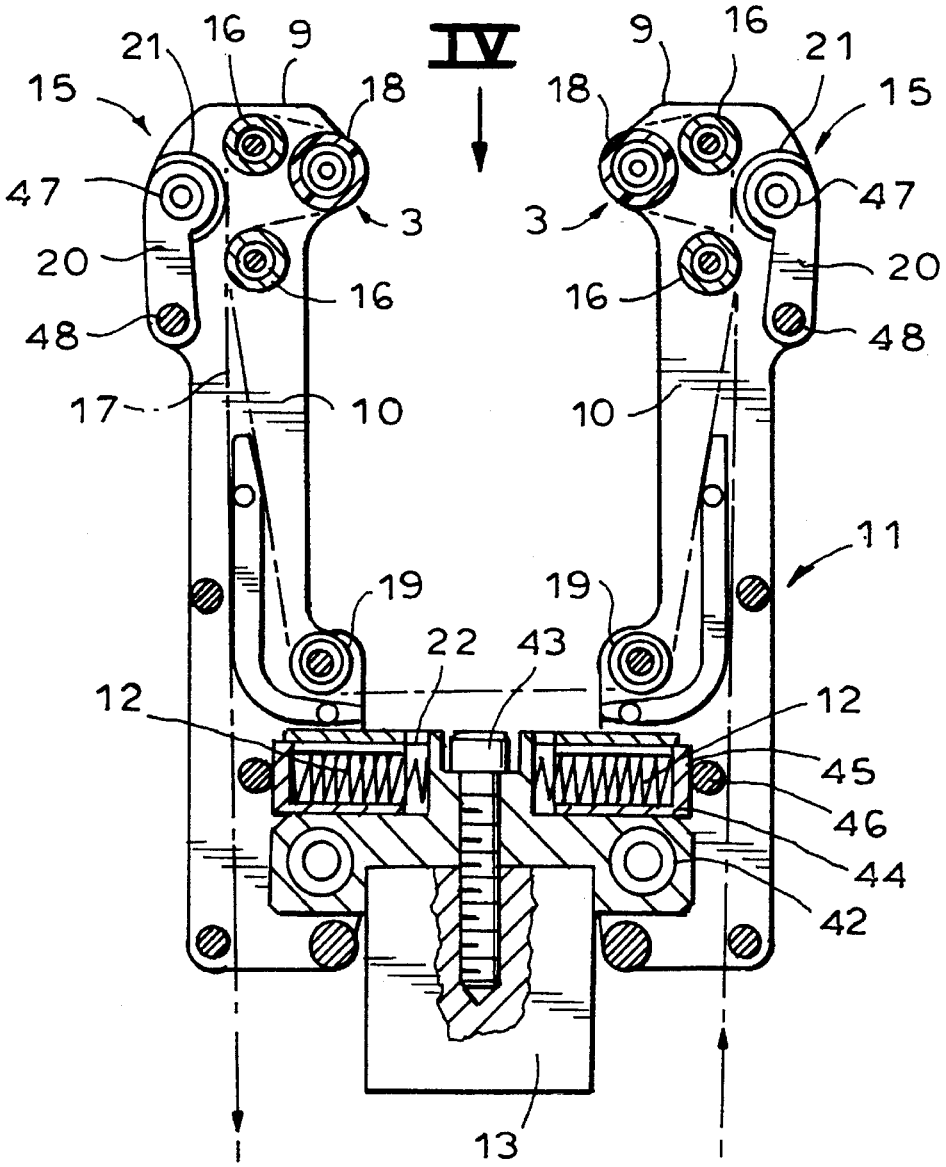
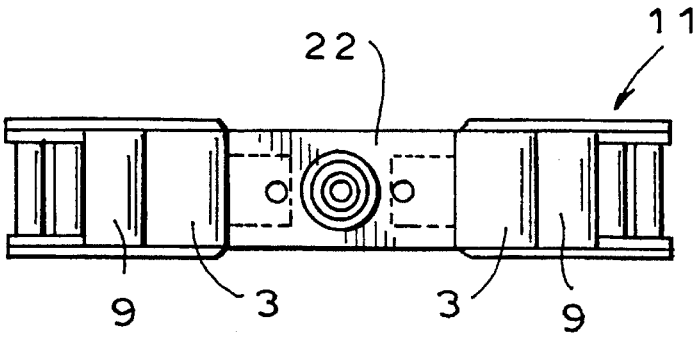
FIG. 4

MACHINE FOR THE TWO-STAGE MACHINING OF PREGROUND SHAFTS

FIELD OF THE INVENTION

The present invention relates to a machine for the two-stage machining of preground shafts, especially automotive vehicle camshafts. More particularly this invention relates to the type of apparatus in which the machine is effected with two sets of grinding or polishing tools or "stones" between the ends of a pair of levers which are program controlled to press the tools against the workpiece from opposite sides thereof.

BACKGROUND OF THE INVENTION

Shafts such as automotive camshafts which are preground in earlier stages of the process, can be subjected to a prefinish grinding or polishing and a fine-finish grinding or polishing in an apparatus wherein two sets of grinding or polishing tools are used, between ends of a pair of levers, at which the tools can be provided and which can be pressed against the workpiece.

For that purpose, the levers are provided with respective actuators, e.g. fluid-operated piston-and-cylinder assemblies which, under the control of a programming unit, can be operated to urge the tools toward and away from the axis of the workpiece.

An earlier machine of this type is described in German Patent DE 38 41 976, commonly owned with this application.

In that apparatus, the two sets of tools for one and the other stage of the machining operation are brought into play by vertically displacing the lever assembly, i.e. raising and lowering the lever assembly.

While that system has been found to be highly effective for two-stage machining, it is insufficiently versatile to accommodate all of the possibly different grinding and polishing requirements.

For example, the grinding stones cannot be simply and easily interchanged or replaced, thereby posing a handicap when an automated system is desired. It is also not possible with that earlier system to conventionally substitute grinding or polishing tools utilizing, for example, a continuous grinding belt.

OBJECTS OF THE INVENTION

It is, therefore, the principal object of the present invention to provide an improved apparatus which retains the advantages of the earlier double-lever arrangement for programmed two-stage machining of a workpiece, especially a preground shaft and more particularly an automotive camshaft, without the drawbacks thereof.

It is another object is the invention to provide an improved apparatus for the purposes described which is more flexible than the earlier apparatus and enables a variety of different grinding or polishing tools or units to be used.

Still another object of this invention is to so improve an apparatus of the type described as to enable it to effect grinding or polishing utilizing a flexible belt which forms the tool or tools for carrying out at least one of the machining operations.

SUMMARY OF THE INVENTION

These objects and others which will become apparent hereinafter are attained, in accordance with the invention in a machine for the two-stage machining of preground shafts, especially automotive vehicle camshafts, in which a prefinishing is carried out with prefinish polishing or grinding stones engageable with opposite sides of the shaft or workpiece and with a pair of fine finish grinding or polishing tools or "stones" juxtaposed with the shaft from opposite sides to effect the fine finish machining.

According to the invention, the machine comprises:

a pair of levers fulcrummed to enable free ends of the levers to be displaced toward and away from an axis of a workpiece disposed between the ends;

respective actuators connected with the levers for displacing same;

a programming unit operatively connected with the actuators for controlling machining of the workpiece;

respective tools on the ends of the levers engageable with the workpiece for effecting one stage of a two-stage machining process under control of the unit, the two-stage machining process including a pre-finish grinding and a fine-finish grinding; and a tool-carrier tongs insertable between the ends into the pair of levers and retractable from between the ends, the tongs comprising:

a carrier, a pair of arms articulated to the carrier and having free ends respectively coupled to the ends of the levers upon insertion of the tool-carrier tongs between the ends of the levers, respective restoring springs on the carrier braced against the arms whereby the arms are movable under control of the unit against the springs, and respective tools carried by the arms and engageable with the workpiece for effecting the other of the stages of the two-stage machining of the workpiece.

The invention is based upon the fact that the two levers of the double lever assembly need not carry both sets of grinding or polishing stones or tools directly for the program-controlled two-stage machining operation. Rather, one set of tools can be provided directly on the lever whereas the other set of tools can be provided upon a tongs which, when inserted between the ends of the levers of the double lever arrangement, can allow the programming unit to act on the arms of the tongs through the levers for controlling another stage of the machining process. It is thus possible, without great cost, to allow substitution of the tools which have hitherto been placed directly on the levers for the second machining operation or the other machining operation, by a tong which can be inserted into or removed from between the pair or levers. The restoring springs which are necessary in this case can be mechanical springs or a pneumatic or hydraulic spring.

The tongs themselves can be controllable and can be programmed if desired. By withdrawing or inserting the tongs a set of tools can be replaced in operating position and, of course, the tongs allows any desired type of tool to be used. For example, the tongs can be equipped with a grinding or polishing belt which can be immobilized so that successive parts of the belt can be rendered effective for successive grinding or polishing operations.

The machine has been found to be especially flexible in permitting a variety of different machining processes to be carried out with different workpieces. When, for example, the workpiece is a motor vehicle camshaft having a succession of cams which are to be machined therein, a multiplicity of units of the type described herein can be provided one behind the other for simultaneously machining a plurality of parts of the same shaft.

The double lever arrangement according to the invention is constructed and arranged to be set back (outwardly) from a working position of the tools at the ends of the levers to accommodate the tongs between these ends.

The levers can be raised and lowered and the carrier of the arms of the tongs can be a slide, or can be mounted on a slide, shiftable toward and away from a workpiece from a side thereof opposite that along which the double lever assembly is provided.

According to a feature of the invention,the ends of the levers can have respective coupling rollers and these coupling rollers can engage in respective receivers at the free ends of the respective arms of the tongs for the coupling of the tongs to the levers. The receivers themselves may be beds formed by pairs of rollers on the arms. In any event, each of the arms of the tongs has at least one roller engageable by one of the coupling rollers to form a bed constituting the respective receiver.

Each arm of the tongs is formed with a pressing roll juxtaposable with the workpiece and having an endless grinding belt guided through the tongs passing thereover to for a respective tool of the respective arm, the belt passing on each arm around a pair of deflecting rollers, each arm having a respective blocking element engaging the belt against the deflecting rollers of each arm to immobilize the belt, the blocking elements being actuated upon engagement of the tongs between the ends of the levers.

The belt can pass in a U-shaped pattern along the arms and the carrier of the tongs. The coupling rollers can bear against the blocking elements, each of the blocking elements including a blocking roller on an end of a lever fulcrummed on the respective arm.

When a grinding or polishing belt is provided and basis over the respective pressing roller, the combination of that pressing rollers and the band or belt, upon immobilization thereof, forms the grinding or polishing stone for the respective arm of the tongs.

BRIEF DESCRIPTION OF THE DRAWING

The above and other objects, features, and advantages will become more readily apparent from the following description, reference being made to the accompanying drawing in which:

FIG. 3 is a detailed view of the tongs, partly in section and in highly diagrammatic form, enlarged with respect to FIGS. 1 and 2; and FIG. 4 is a view taken in the direction of the arrow IV of FIG. 3.

SPECIFIC DESCRIPTION

Figure 1:
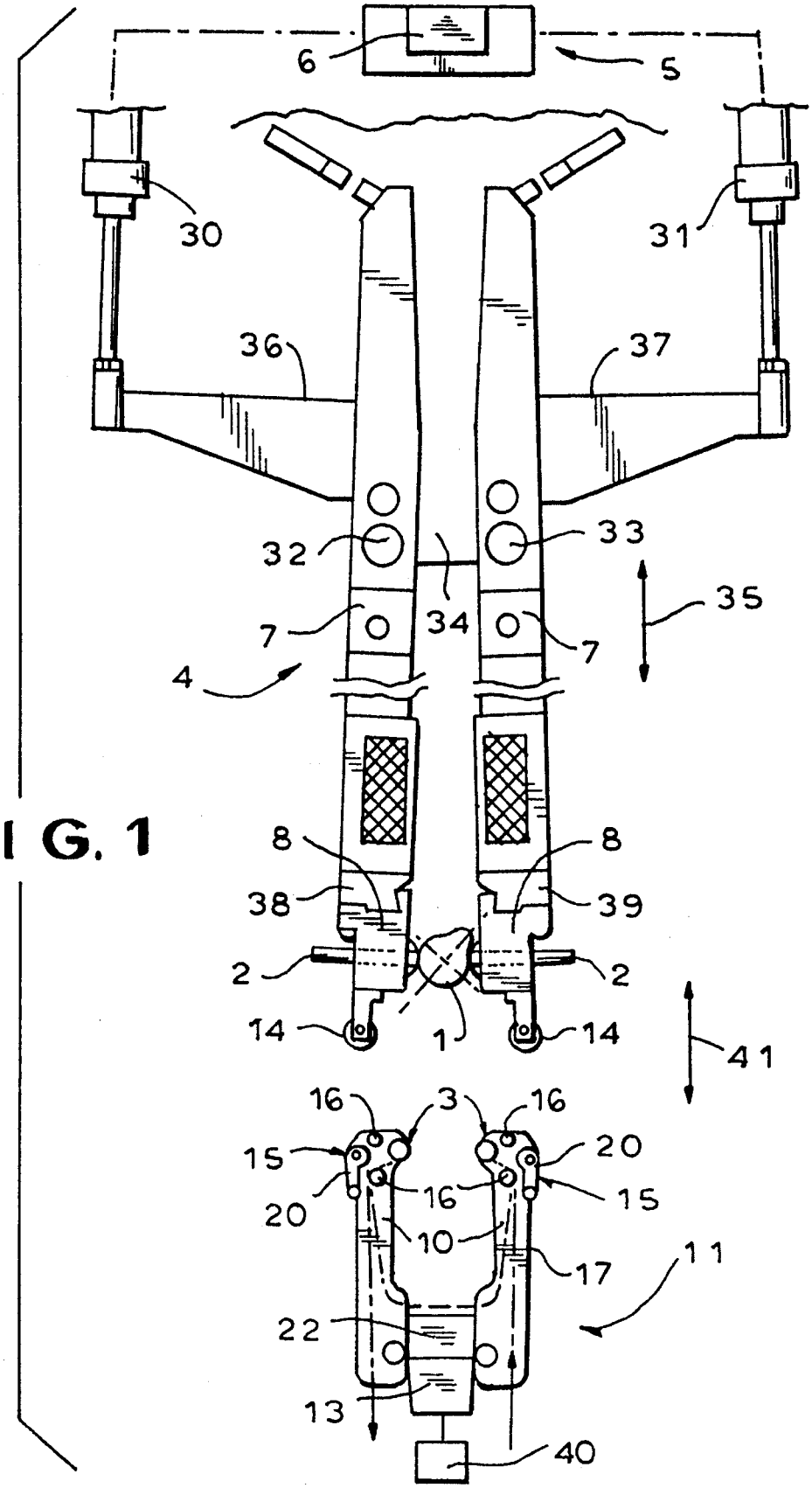
FIG. 1 is an elevational view in highly diagrammatic form and partly broken away, of a machine for the two-stage grinding of camshafts according to the invention, the tongs being shown in its position withdrawn from the pair of levers.

The apparatus shown in the drawing is utilized for the two-stage machining of preground shafts 1, especially motor vehicle camshafts, in a prefinish polish or grinding operation and a fine finish polish or grinding operation. For this purpose, the prefinish grinding stones 2 or the fine section grinding tools 3 are used.

The apparatus comprises at least one double lever assembly 4, and a control unit 5 for operating the double lever assembly 4 and programmable with the programming unit 6. The programming unit 6 acts upon the levers 7 via the hydraulic or pneumatic piston-and-cylinder units 30 and 31. The levers 7 may be fulcrummed at 32 and 33 on a-carrier 34 which is moved vertically as represented by the double headed arrow 35 and carries arms 36 and 37 to which the cylinder units 30 and 31 are connected. The levers 7 are formed at their ends 38 and 39 with fittings enabling tool holders 8 to be removably mounted thereon, the tool holders 8 carrying the grinding or polished stones 2 for one of the machining operation of the two-stage machining processes previously described.

The tool holders for the grinding or polishing tools 3 for the second stage of the processes are represented at each and are provided at the ends of arms of a tool-carrier tongs 11 which is formed in turn with a carrier 22 mounted on or forming part of a slider 13 displaceable in response to the programming 5 by an actuator 40 in the direction of the double arm lever 41.

The arms 10 of the tongs open toward the ends of the levers 7 between which these arms are to be received and with which these arms can be coupled.

Figure 2:
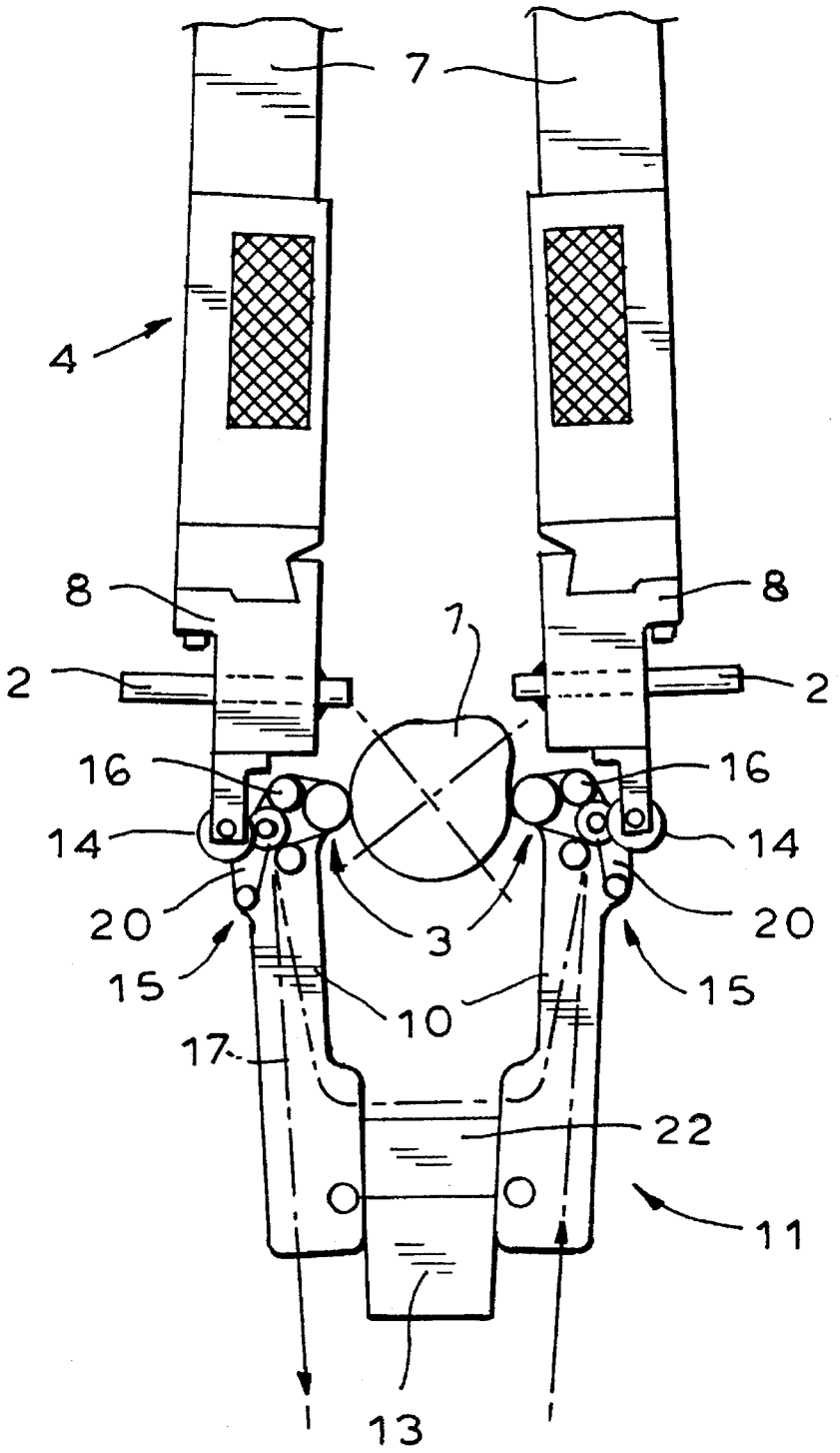
FIG. 2 is an elevational view, also broken away showing the levers coupled to the tongs.

As a comparison of FIGS. 1 and 2 will show, for the second stage in the machining operation, the tongs 11 are received between the levers 7 of the double lever assembly 4 and the arms can be pressed toward the axis of the workpiece against the effect of restoring springs 12 by the controlled unit 5 in response to the programming slide at 6. The restoring springs 12 are shown in greater detail in FIG. 3. The arms 10, for example, are fulcrummed at pivots 42 on the carrier 22 which is connected by a bolt 43 to the slider 13.

The springs 12 are received in compartments 44 of the carrier 22 and are surrounded by sleeves 45 which are pressed outwardly against pins 46 connected to the arms 10 to provide the restoring values.

The double lever unit 4 can be supplied for the coupling of the tongs 11 to these levers, from the working position and in this coupling position, the tools can be spaced from the workpiece, e.g. outwardly thereof or vertically therefrom (see FIG. 2).

The double arm lever 4 thus can be raised and lowered as has been described and, of course, the tongs 11 can be raised and lowered to engage in the levers 7.

While the levers 7 and the arms 10 have been shown to extend substantially vertically, it will be understood that the assembly can be inclined to the vertical as may be desirable or required.

For coupling the levers 7 to the arms 10 of the tongs 11, the levers 7 are provided with respective coupling rollers 14 which, in the coupled state of the tongs 11, engage in receivers 15 of the arms 10. The receivers 15 can be formed by pairs of rollers or even by a single roller 47 on a respective lever 20 pivotally connected at 48 to the respective arm 10.

In the embodiment described, the grinding or polishing element of the tongs 11 is a grinding or polishing belt 17 which passes over a respective pressing roller 18 to form the respective grinding stone when that belt is immobilized. The belt 17 passes in a U-shaped pattern from a coil not shown around the deflecting rollers 16 and the pressing roller 18 on one arm 10 then around deflecting rollers 19 across the carrier 22 about the rollers 16 and the pressing roller 18 of the other arm to a take up coil, not shown.

To immobilize the band or belt on the rollers 18, each of the levers 20 carry a blocking element or roller 21 which can press against the belt 17 and the rollers 16 of the respective arm (see FIG. 2) being pushed inwardly by the respective coupling roller 14 when the tongs is connected to the levers 7.

The delivery and takeup coils can be provided directly on the tongs if desired.

In operation, the prefinish machining is carried out with the tools 2 in the manner described in the aforementioned patent and under the control of the unit 6, the levers 7 are drawn upwardly and the tongs 11 placed between the levers to couple the tongs to the levers 7, whereupon machining is effected as shown in FIG. 2 with immobilized process of the belt 17.

When machining is complete, the tongs 11 are pulled out of the levers 7 and the process can be repeated.

I claim:

1. A machine for a two-stage machining of preground shafts, especially automotive crankshafts, comprising:

a pair of levers fulcrummed to enable free ends of said levers to be displaced toward and away from an axis of a workpiece disposed between said ends;

respective actuators connected with said levers for displacing same;

a programming unit operatively connected with said actuators for controlling machining of said workpiece;

respective tools on said ends of said levers engageable with said workpiece for effecting one stage of a two-stage machining process under control of said unit, said two-stage machining process including a pre-finish grinding and a fine-finish grinding; and a tool-carrier tongs insertable between said ends into said pair of levers and retractable from between said ends, said tongs comprising:

a carrier, a pair of arms articulated to said carrier and having free ends respectively coupled to said ends of said levers upon insertion of the tool-carrier tongs between the ends of said levers, respective restoring springs on said carrier braced against said arms whereby said arms are movable under control of said unit against said springs, and respective tools carried by said arms and engageable with said workpiece for effecting the other of said stages of the two-stage machining of the workpiece.

2. The machine defined in claim 1 wherein said levers are constructed and arranged so as to be set back from a working position of the tools on the ends of said levers to disengage said tools on the ends of said levers from said workpiece and permit said tongs to be received between said ends of said levers and the tools on the free ends of said arms to engage said workpiece.

3. The machine defined in claim 1 wherein said levers are mounted to be raised and lowered relative to said workpiece, said carrier being a slide shiftable toward and away from said workpiece from a side thereof opposite that along which said levers are provided.

4. The machine defined in claim I wherein each of said ends of said levers is provided with a respective coupling roller engaging in a receiver of a respective arm of said tongs upon coupling of said tongs to said levers.

5. The machine defined in claim 4 wherein each said arms of said tongs has at least one roller engageable by one of said coupling rollers to form a bed therefor constituting the respective receiver.

6. The machine defined in claim 5 wherein each arm of said tongs is formed with a pressing roll juxtaposable with said workpiece and having an endless grinding belt guided through said tongs passing thereover to for a respective tool of the respective arm, said belt passing on each arm around a pair of deflecting rollers, each arm having a respective blocking element engaging the belt against the deflecting rollers of each arm to immobilize the belt, said blocking elements being actuated upon engagement of said tongs between said ends of said levers.

7. The machine defined in claim 6 wherein said belt passes in a U-shaped pattern along said arms and said carrier.

8. The machine defined in claim 7 wherein said coupling rollers bear against said blocking elements, each of said blocking elements including a blocking roller on an end of a lever fulcrummed on the respective arm.

9. The machine defined in claim 8 wherein said levers are constructed and arranged so as to be set back from a working position of the tools on the ends of said levers to disengage said tools on the ends of said levers from said workpiece and permit said tongs to be received between said ends of said levers and the tools on the free ends of said arms to engage said workpiece.

10. The machine defined in claim 8 wherein said levers are mounted to be raised and lowered relative to said workpiece, said carrier being a slide shiftable toward and away from said workpiece from a side thereof opposite that along which said levers are provided.

11. The machine define in claim 1 wherein said tongs are equipped with a grinding belt immobilizable to form the tools on said arms.

12. The machine defined in claim 1 wherein each arm of said tongs is formed with a pressing roll juxtaposable with said workpiece and having an endless grinding belt guided through said tongs passing thereover to for a respective tool of the respective arm, said belt passing on each arm around a pair of deflecting rollers, each arm having a respective blocking element engaging the belt against the deflecting rollers of each arm to immobilize the belt, said blocking elements being actuated upon engagement of said tongs between said ends of said levers.

13. The machine defined in claim 12 wherein said belt passes in a U-shaped pattern along said arms and said carrier.

14. The machine defined in claim 13 wherein said coupling rollers bear against said blocking elements, each of said blocking elements including a blocking roller on an end of a lever fulcrummed on the respective arm.

15. The machine defined in claim 14 wherein said levers are constructed and arranged so as to be set back from a working position of the tools on the ends of said levers to disengage said tools on the ends of said levers from said workpiece and permit said tongs to be received between said ends of said levers and the tools on the free ends of said arms to engage said workpiece.

16. The machine defined in claim 15 wherein said levers are mounted to be raised and lowered relative to said workpiece, said carrier being a slide shiftable toward and away from said workpiece from a side thereof opposite that along which said levers are provided.

* * * * *